US005131308A

United States Patent [19]

Katsuta

[11] Patent Number: 5,131,308

[45] Date of Patent: Jul. 21, 1992

[54] KEYBOARD DEVICE OF ELECTRONIC KEYBOARD MUSICAL INSTRUMENT

[75] Inventor: Masanori Katsuta, Iwata, Japan

[73] Assignee: Kawai Gakki Seisakusho Co., Ltd., Hamamatsu, Japan

[21] Appl. No.: 634,688

[22] Filed: Dec. 27, 1990

[30] Foreign Application Priority Data

Dec. 29, 1989 [JP] Japan ..... 1-151524[U]

[51] Int. Cl.[5] ..... G10C 3/12

[52] U.S. Cl. ..... 84/434; 200/5 R

[58] Field of Search ..... 84/433, 434, 435; 200/5 A, 5 R, 341, 342, 343, 344, 345

[56] References Cited

U.S. PATENT DOCUMENTS 4,604,937 8/1986 Kumano et al. .

FOREIGN PATENT DOCUMENTS 57-3285 1/1982 Japan .
57-25261 6/1982 Japan .
58-7425 2/1983 Japan .
58-50356 11/1983 Japan .

*Primary Examiner*—Harold Broome
*Attorney, Agent, or Firm*—Fleit, Jacobson, Cohn, Price, Holman & Stern

[57] ABSTRACT

A keyboard of an electronic musical instrument has the keys hinged to a chassis which has key-hole shaped openings receiving moveable switch contacts supported from below the chassis on a switch plate. Each key has an actuator for depressing the respective switch, and a projecting rod for engaging the upper surface of the switch plate to limit downward movement of the key. The key further has a side wall with a lower end portion formed as a stopper which engages the undersurface of the switch plate to limit upward movement of the key. A switch guide fitted to the chassis guides the side walls of the respective keys.

3 Claims, 2 Drawing Sheets

KEYBOARD DEVICE OF ELECTRONIC KEYBOARD MUSICAL INSTRUMENT

BACKGROUND OF THE INVENTION

1. Field of the Invention

This invention relates to a keyboard device of an electronic keyboard musical instrument which has a simple construction, can be produced easily and can provide a stable key pressing operation.

2. Description of the Prior Art

A keyboard device such as the one shown in FIG. 6 of the accompanying drawings, for example, is known as a keyboard device of conventional portable electronic musical instrument, or the like. As shown in the drawing, each key 1 is equipped with a thin and flat hinge portion 2 at its rear end (on the right side in the drawing) and a plurality of keys 1 are integrally molded from a synthetic resin and fitted to the rear part of the upper surface of a chassis 3. A buffer material 4 such as a felt is bonded to both upper and lower surface of the chassis 3 on the foreground side (on the left side in the drawing) so that the lower limit position is restricted by the contact between this buffer material 4 and the lower surface on the back of the keys 1, and similarly, the upper limit position is restricted by the contact with a stopper 5 that is suspended and bent downward. Furthermore, switch supports 6 push a keyboard switch 7 fitted to the back of the chassis.

However, the keyboard device described above does not have any particular means for restricting the transverse shake or vibration of each key 1 and its push-down direction which are barely restricted only by molding accuracy of the hinge portions 2 of the keys 1. Accordingly, the conventional keyboard device involves the problems that if molding accuracy is low or if adjacent keys 1, 1' come into mutual contact due to the change with time and the keys 1 are inclined as shown in FIG. 7, the key arrangement on the upper surface of the keyboard goes out of order, appearance of the keyboard drops as a whole and noise is generated during the key pressing operation.

Further, it is difficult to bond linearly the buffer material 4 having as much a length as required for the arranged keys to the chassis 3 in the key arrangement direction and since the buffer material 4 must be bonded to both upper and lower surfaces, this bonding work is extremely troublesome and time-consuming. Another problem is that if a cantilever support structure is employed for the printed board 7, only one of its sides is supported and consequently, the printed board undergoes deflection as the switch support 6 is lowered by pressing operation of the keys 1. Accordingly, a normal switch operation cannot be obtained. If the printed board 7 is fixed at its front and rear portions, the number of necessary screws increases and the number of man-hours for assembly increases as much.

SUMMARY OF THE INVENTION

The present invention intends to solve these problems with the prior art devices. In order to accomplish this object, the present invention provides a keyboard device of an electronic keyboard musical instrument which comprises a plurality of keys, each of which is equipped with a switch support, a projecting rod and a slide wall portion having its lower end portion acting as a stopper which are formed in that order from the center to the foreground side of the key and project from the back thereof, and which has a hinge portion formed at its tip; a chassis which has fixed thereto the hinge portions of the keys and is equipped with keyhole-like switch insertion holes bored at positions corresponding to the switch supports and projecting rods of the keys and with through-holes bored at positions corresponding to the slide wall portions; a keyboard switch which consists of a plate on the upper side equipped with moving contacts and a printed board on the lower side equipped with fixed contacts and superposed with the plate on the upper side, the moving contacts being fitted into the switch insertion holes, the plate being fixed onto the lower surface of the chassis in such a manner that part of its upper surface is exposed partially at the keyhole corner portions of the switch insertion holes; and a key guide which is equipped with guide members corresponding to the slide wall portions of the keys in such a manner as to guide the slide wall portions that are formed continuously with one another, and is fitted to the chassis; wherein engagement between the stoppers at the lower end portion of the slide side wall portions and the lower surface of the keyboard switch sets the movable upper limit of the keys and engagement between the projecting rods of the keys and the upper surface of the keyboard switch sets the movable lower limit of the keys.

The present invention provides the keyboard device of an electronic keyboard musical instrument described above, wherein the plate equipped with the moving contacts in the keyboard switch is made of a flexible material.

Furthermore, the present invention provides the keyboard device of an electronic keyboard musical instrument described above, wherein the key guide is fitted to the chassis in such a manner that the upper edge of the wall extended rearward from a guide member of the key guide pushes the keyboard switch to the chassis.

Since a plate 25 for moving contacts 26 and a printed board 27 for fixed contacts are supported by a key guide 20, fitting of a keyboard switch 24 becomes easy. Since the movable upper and lower limits of the keys are set by the upper and lower surfaces of the plate of a keyboard switch 25 equipped with the moving contacts 26, a key pressing operation can be made accurately and an excellent keyboard arrangement and a key pressing operation with excellent touch and feel can be obtained by the key guide 20.

DESCRIPTION OF THE PREFERRED EMBODIMENTS

Hereinafter, preferred embodiments of the present invention will be described with reference to the accompanying drawings.

Figure 1:
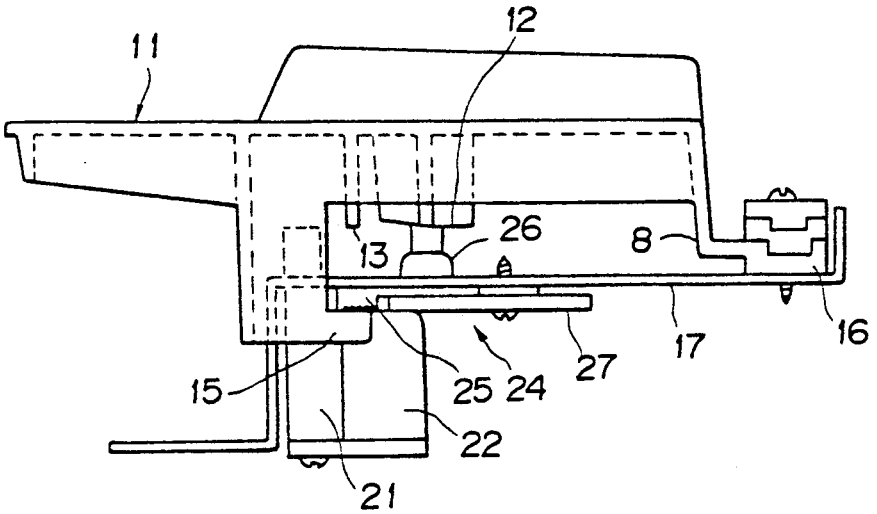
FIG. 1 is a side view showing the principal portions of a keyboard device accordance with an embodiment of the invention.
Figure 2:
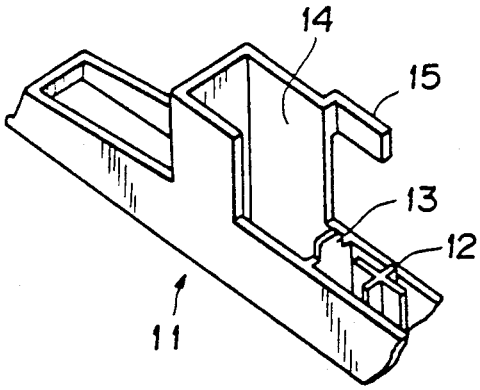
FIG. 2 is a perspective view showing part of the back of the keyboard in the present invention.

FIG. 1 is a side view showing the keyboard device in accordance with an embodiment of the present invention and FIG. 2 is a perspective view of part of the back of a keyboard. As shown in these drawings, each key 11 includes a projecting rod 13 which is formed in the foreground (on the left side in the drawings) of a switch actuator 12, a slide wall portion 14 which is formed further in the foreground side of the projecting rod 13 and has a U-shaped section and parallel both sides and a stopper 15 which is disposed in a bent form at the lower end of the slide wall portion 14. A plurality of keys 11 are formed integrally by a fitting portion 16 at the back of the keys 11 through a hinge portion 8.

Figure 3:
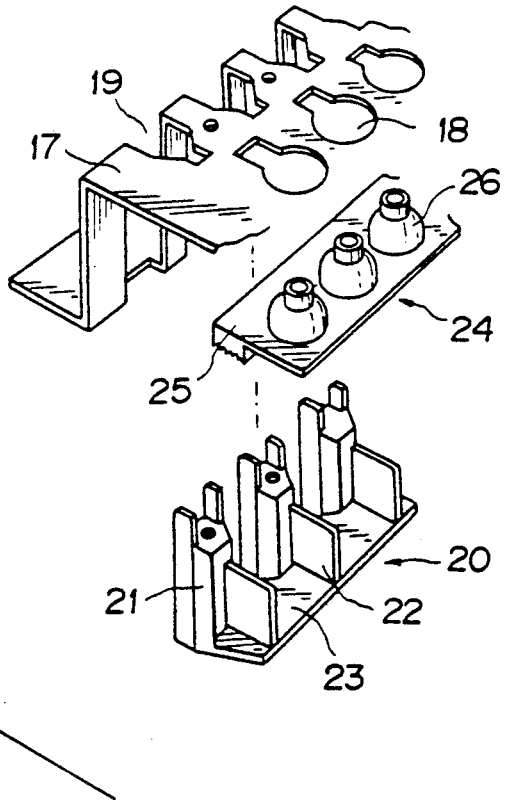
FIG. 3 is a perspective view showing the principal under the assembled state of FIG. 1.

As shown in FIG. 3 which is a partial perspective view of a chassis 17 (where a printed board is omitted), the chassis 17 includes keyhole-like switch insertion holes 18 each of which is bored at the position corresponding to the switch actuator 12 when each key 1 is fitted at the fitting portion 16 to the chassis 17 and through-holes 19 on the foreground side through which the slide wall portions 14 of the keys 11 are fitted.

Each key switch insertion hole 18 has the keyhole-like shape so that the projecting rod 13 suspended from the key 11 can engage with a plate 25 of the keyboard switch exposed from the keyhole corner portion but this shape is not particularly limitative. Therefore, the switch insertion holes 18 may be disposed individually at positions corresponding to the switch actuators 12 of the keys 11 and the projecting rods 13.

Reference numeral 20 represents a keyboard guide. The keyboard guide 20 is formed integrally for a plurality of keys on a base 23 by forming longitudinally elongated guide members 21 having a width somewhat smaller than the gap of a slide portion side wall 14 of the keys 11 and then extending walls 22 at the back of the guide members 21.

A plurality of cup-like moving contacts 26 having an electrically conductive rubber contact are formed integrally on a plate 25 made of a flexible material and a printed board 27 having fixed contacts printed thereon is superposed with the lower surface of the plate 25 in order to constitute the keyboard switch 24.

In the keyboard device having such a construction, the cup-like moving contacts 26 are fitted into the switch insertion holes 18 from the back of the chassis 17 and are clamped by the printed board 27 and one of the ends of the printed board 27 is fixed to the chassis 17. The slide portion 14 of each key 11 is fitted into the through-hole 19 of the chassis 17 and the fitting portion 16 at the rear of each key is fitted to the chassis 17. Since the key guide 20 is fixed from the back to the chassis 17 in such a manner that its guide member 21 exists between the through-holes 19 of the chassis 17, the guide member 21 of the key guide 20 is under the state where it is fitted into the slide wall portion 14 of the key 11 and the rear wall 22 pushes the lower surface of the plate 25 of each moving contact 26 and the other end of the printed board 27.

The upper limit of the key 11 is limited as the stopper 15 which projects from the slide wall portion 14 butts against the back of the plate 25 of the movable contact 26.

Under the key pressed state, the movable contact 26 of the keyboard switch 24 is closed by the switch actuator 12 of the key and the projecting rod 13 comes into contact with the upper surface of the plate 25 of the moving contact 26, which is pressed and supported by the upper edge of the wall 22 of the key guide 20, through the corners of the switch insertion hole 18 having the keyhole-like shape, so that the lower limit of the key striking operation of the key 11 is limited.

Figure 4:
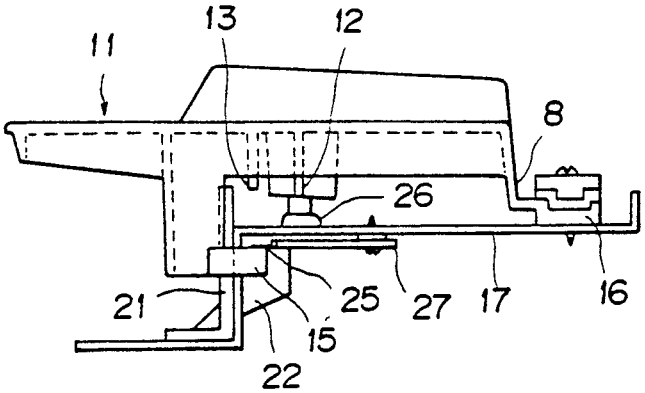
FIG. 4 is a side view showing the keyboard device in accordance with another embodiment of the present invention.
Figure 5:
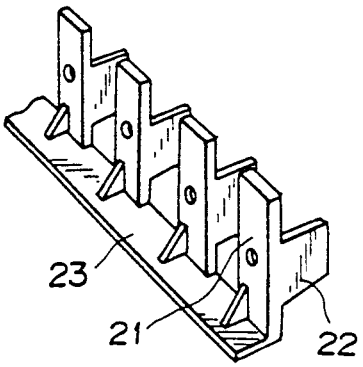
FIG. 5 is a perspective view showing the principal portions of the key guide shown in FIG. 4.
Figure 6:
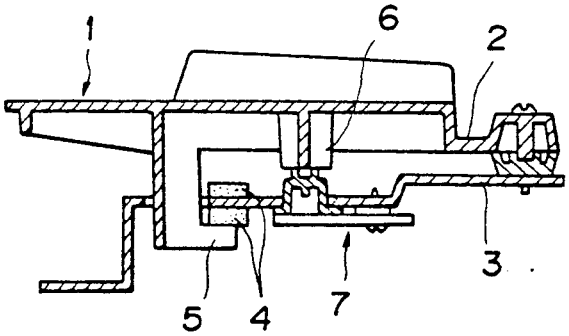
FIG.6 (PRIOR ART)
FIG. 6 is a side view showing a conventional keyboard device.
Figure 7:
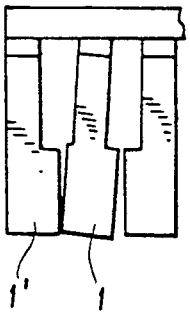
FIG.7 (PRIOR ART)
FIG. 7 is a plan view showing a conventional keyboard.

FIG. 4 shows the keyboard device in accordance with another embodiment of the present invention. This embodiment has the structure wherein the key guide 20 is produced by forming integrally the walls 22 extending from the guide members 21 in such a manner as to extend rearward from the base 23 as shown in FIG. 5 and this key guide 20 is fitted to the chassis 17 bent at right angles from the front side of the keys 11. The rest of the constructions are the same as those of the embodiment shown in FIGS. 1 to 3.

According to the keyboard device in accordance with the present invention as described above, the position of each key and its transverse shake or vibration are restricted by the slide wall portion and the key guide fitted to the chassis. Therefore, the present device provides the effects that the keys can be arranged accurately, a keyboard having excellent arrangement of the keys as a whole can be obtained and the key pressing operation having excellent touch feel can be obtained, as well.

Since the upper and lower limit positions of the key striking operation are restricted by the upper and lower surface of the flexible plate of the moving contact, higher regulation accuracy can be obtained than the conventional structure wherein the upper and lower limit positions are regulated by independent buffer materials, and the buffer material becomes unnecessary. Consequently, the number of components and the number of man-hours for assembly can be reduced.

Furthermore, since the plate 25 of the moving contact and the other end of the printed board are pressed and supported by the upper edge of the wall 22 of the keyboard guide 20, the keyboard switch 24 can reduce the number of screws and the like and can be fitted easily. Even if any small gap exists between the upper edge of the wall 22 and the lower surface of the printed board 27, deflection of the printed board 27 is restricted at the upper edge of the wall 22 by the lowering of the switch actuator 12 and a deflection quantity becomes constant.

What is claimed is:

1. A keyboard device of an electronic keyboard musical instrument comprising:

a plurality of keys, each being equipped with a switch actuator, a projecting rod and a slide wall portion having a lower end portion defining a stopper and which actuator, rod and wall portion are formed in order from a center part of said key to a forward end of said key and project from a back surface thereof, and the key having a rear end tip formed with a hinge portion;

a chassis with upper and lower surfaces having fixed thereto said hinge portions of said keys, and equipped with keyhole-like switch insertion holes bored at positions corresponding to said switch actuators and said projecting rods of said keys and with through-holes bored at positions corresponding to said slide wall portions;

a keyboard switch consisting of a plate having an upper side equipped with moving contacts and a lower side fitted with a printed board equipped with fixed contacts, said moving contacts being fitted into said switch insertion holes, said plate being fixed onto the lower surface of said chassis in such a manner that part of the upper side of the plate is exposed partially at the keyhole corner portions of said switch insertion holes; and a key guide fitted to the chassis and equipped with guide members corresponding to said slide wall portions of said keys in such a manner as to guide said slide wall portions that are formed continuously with one another;

wherein engagement between said stoppers defining the lower end portion of said slide side walls and the lower side of said keyboard switch plate sets the movable upper limit of said keys and engagement between said projecting rods of said keys and the upper side of said keyboard switch plate sets the movable lower limit of said keys.

2. A keyboard device of an electronic keyboard musical instrument according to claim 1, wherein said keyboard switch plate is made of a flexible material.

3. A keyboard device of an electronic keyboard musical instrument according to claim 1, wherein said key guide has a wall extended rearward from each guide member and which recess the respective keyboard switch to said chassis.

* * * * *